US005164069A

United States Patent [19]

Cerwonka

[11] Patent Number: 5,164,069

[45] Date of Patent: Nov. 17, 1992

[54] NICKEL ELECTROPLATING SOLUTION AND ACETYLENIC COMPOUNDS THEREFOR

[75] Inventor: Edward J. Cerwonka, Woburn, Mass.

[73] Assignee: Shipley Company Inc., Newton, Mass.

[21] Appl. No.: 609,442

[22] Filed: Nov. 5, 1990

[51] Int. Cl.[5] ..... C25D 3/16

[52] U.S. Cl. ..... 205/271; 106/1.19; 205/275; 205/278

[58] Field of Search ..... 204/24, 49, 48; 205/271, 275, 278; 106/1.19

[56] References Cited

U.S. PATENT DOCUMENTS

| | | | |
|---|---|---|---|
| 3,634,207 | 1/1972 | Toledo | 204/49 |
| 3,804,727 | 4/1974 | Lyde | 204/49 |
| 3,839,465 | 10/1974 | Schneider et al. | 205/271 |

*Primary Examiner*—John Niebling
*Assistant Examiner*—Brian M. Bolam
*Attorney, Agent, or Firm*—Robert L. Goldberg

[57] ABSTRACT

An aqueous acid electroplating solution comprising nickel ions and one or more acetylenic compounds, specifically mono- and polyglyceryl ethers of acetylenic alcohols; acetylenic compounds useful in the electroplating solution; and processes using such solution and compounds. The invention is particularly useful for nickel plating an irregular surface such as a printed circuit board having through-holes.

20 Claims, No Drawings

NICKEL ELECTROPLATING SOLUTION AND ACETYLENIC COMPOUNDS THEREFOR

BACKGROUND OF THE INVENTION

1. Introduction

This invention relates to a nickel electroplating solution, compounds useful in the electroplating solution, and processes for use of the electroplating solution.

2. Description of the Prior Art

Electrodeposition processes of nickel and other compounds often provide a dull or discolored substrate surface in low current density areas. This problem has been addressed with varying success through addition of brightening and leveling agents to an electroplating solution.

Specifically, several acetylenic alcohols and diols have been used as brightening agents in nickel electroplating solutions. See, for example, U.S. Pat. No. 3,711,384; and F. A. Lowenheim, *Modern Electroplating, pp.* 271–76 (2d ed., John Wiley & Sons). Nitrogen-containing ring compounds have been used as levelers and certain pyridinium compounds have been used in combination with certain acetylenic compounds. See, for example, U.S. Pat. Nos. 2,876,177 and 3,862,019, both incorporated herein by reference. Brightening systems such as these can be crucial to achieve an acceptable nickel deposit and industry would clearly benefit by the discovery of additional brightening agents.

Nickel plating of a surface having irregular topography poses particular difficulties. During electroplating a voltage drop exists along the irregular surface resulting in an uneven nickel deposit. Where the voltage drop is extreme, that is, where the surface irregularity is substantial, it may be not possible to satisfactorily plate the surface.

Thus, successful metal plating is frequently a challenging step in the manufacture of printed circuit boards. Printed circuit boards often have "through-holes", perforations through the board surface to provide attachment means for the board hardware and, in the case of a multilayer board, to provide interconnection between each board layer. Processes for formation of conductive through-holes are well known and described in numerous publications including U.S. Pat. No. 4,515,829, incorporated herein by reference. The walls of a through-hole are metalized to provide conductivity between the multiple circuit layers of the board. Electroless plating procedures are used to form a first metallic coating over the through-hole wall and then an electrolytic deposit is employed to enhance the electroless layer. Nickel is often pattern plated over a copper deposit to provide a barrier layer which prevents diffusion between the underlying copper layer and a subsequently applied metal layer. For example, gold is frequently plated over such a nickel barrier layer to provide a metal etch resist. See, generally, Coombs, *Printed Circuit Handbook,* p. 7–22 (2d ed. 1979).

Manufacture of an acceptable printed circuit board having through-holes requires electroplating completely through the length of the barrel of the hole from the surface pad on each board side. A surface pad is a plated area on the plane surface of a printed circuit board through which a through-hole is drilled.

A voltage drop exists between the surface pad and the midpoint of the barrel of a through-hole. This voltage drop is a function of several factors including the through-hole's aspect ratio. The term "aspect ratio" refers to the thickness of a printed circuit board divided by the diameter of the through-hole of the board.

The thickness of electrodeposited metal is usually at a maximum at the plane surface of the surface pad tapering to a minimum midway along the length of the through-hole. With prior nickel electroplating systems, satisfactory nickel plating of high aspect ratio through-holes has been difficult or simply not possible. Nickel will be either completely absent or plated too thin midway along the length of the through-hole walls. Such inadequate plating results in circuit defects and board rejection.

Thus, to satisfactorily plate a through-hole, a plating solution must have adequate throwing power. In the case of a printed circuit board having through-holes, the term "throwing power" is defined as the ratio of thickness of metal deposited in the mid-barrel of a through-hole to the thickness of metal plated on the through-hole's surface pad. Additionally, it should be clear that throwing power is a function of the aspect ratio of the through-hole being plated. For example, a plating solution may exhibit a throwing power of 1:1 for a low aspect ratio board, but when used to plate a high aspect ratio board the thickness of metal deposited at the through-hole mid-barrel may only be a fraction of a mil (or zero) for every mil of metal plated at the surface pad.

In B. F. Rothschild, *Electronic Packaging and Production*, vol. 15, p. 102 (Aug. 1975), throwing power of an acid copper plating solution was reported to be enhanced through increasing the ratio of sulfuric acid concentration to copper ion concentration. For instance, high throw acid copper baths have been employed with an acid to copper ion ratio of ten to one. See, L. Mayer, et al., *Plating and Surface Finishing.* pp. 46–49 (March 1981). Nickel plating solutions, however, are typically buffered with boric acid and the acid to metal ion ratio can not be well-controlled as in copper systems. The throwing power of a nickel plating solution has been enhanced by increasing the bath's conductivity, for example through use of an all-nickel chloride bath. However, this approach imparts only relatively limited throwing power and consequently does not enable satisfactory nickel plating of printed circuit boards having through-holes of high aspect ratios. Further, an all-nickel chloride solution provides a nickel deposit of relatively high internal stress which may be undesirable in many applications.

SUMMARY OF THE INVENTION

The acetylenic compounds of the invention are of the following Formula (I):

$$R{-}C{\equiv}C{-}R^1{-}[O{-}CH_2{-}CH(R^2)]_n{-}O{-}CH_2{-}CH(OH){-}R^3 \quad (I)$$

wherein

R is selected from the group consisting of hydrogen, $C_{1-8}$ alkyl, $C_{1-8}$ alkoxy, $C_{2-8}$ alkenyl and $C_{2-8}$ alkynyl, any of which groups may be substituted at available positions by one or more hydroxy, halo, cyano and sulfono;

$R^1$ is selected from the group consisting of $C_{1-8}$ alkylene, $C_{2-8}$ alkenylene and $C_{2-8}$ alkynylene, any of which groups may be substituted by one or more $C_{1-5}$ alkyl and $C_{2-5}$ alkenyl;

$R^2$ is selected from the group consisting of hydrogen, $C_{1-5}$ alkyl, $C_{2-5}$ alkenyl and $C_{2-5}$ alkynyl, any of which groups may be substituted at available positions by one or more hydroxy, halo, cyano and sulfono; and $R^3$ is selected from the group consisting of $C_{2-5}$ alkyl, $C_{2-5}$ alkenyl and $C_{2-5}$ alkynyl, any of which groups may be substituted at available positions by one or more hydroxy, halo, cyano and sulfono; and n is any integer greater than zero and less than the value wherein the compound is not soluble in an aqueous acid nickel electroplating solution at concentrations of less than 10 parts of the compound per million parts of the electroplating solution.

Excluded from the claimed compounds of Formula (I) are the compounds wherein (1) R is hydrogen, $R^1$ is $CH_2$ and $R^2$ and $R^3$ are each halomethyl; and (2) R is hydrogen, $R^1$ is $CH_2$ and $R^2$ and $R^3$ are each sulfonomethyl.

In another aspect, the invention provides an aqueous acid nickel electroplating solution comprising nickel ions and one or more compounds of Formula (I) above. The electroplating solution preferably also includes one or more sulfonated pyridinium salts and formaldehyde. The electroplating solution may optionally also include one or more surfactants.

The electroplating solution of the present invention provides exceptional throwing power in addition to bright nickel deposits. Use of the compounds of Formula (I) and corresponding electroplating solution thus permits successful nickel plating of irregular surfaces such as printed circuit boards having through-holes of high aspect ratios and, more specifically, printed circuit boards having through-holes of aspect ratios equal to or greater than nine to one.

DESCRIPTION OF THE PREFERRED EMBODIMENTS

The present invention is useful for plating nickel over a variety of surfaces for a variety of commercial uses. However, the invention is especially useful for the manufacture of printed circuit boards requiring metalized through-hole walls. For this reason, the description which follows is generally directed to printed circuit board fabrication using the electroplating solutions, compounds and processes of the invention.

The compounds of Formula (I) are readily synthesized. For example, one mole of an acetylenic alcohol may be condensed with one or more moles of epichlorohydrin (or other epoxide) under anhydrous conditions in the presence of a Lewis acid catalyst, such as boron trifluoride etherate, to yield an acetylenic glyceryl mono- or polychlorohydrin. The number of chlorohydrin units in the acetylenic glyceryl product is determined by the mole ratio of epichlorohydrin to acetylenic alcohol. The chlorohydrin product then may be hydrolyzed with alkali to yield the corresponding polyol ether.

More particularly, compounds of Formula (I) may be prepared by condensation of acetylenic alcohols with epoxides and other synthetic procedures as disclosed in C. P. Yang, et al., *Tatung Journal*, Vol. XIII, p. 203–213 (Nov. 1983); J. A. Gautier, et al., *Bulletin de la Societe Chimique de France*, no. 9, p. 3190 (1967); G. Cardillo, et al., *Synthesis*, p. 793 (1981); and C. Harrison, *Synthesis*, p. 299 (1980), all incorporated herein by reference.

One or more of the compounds of Formula (I) can be used in the aqueous acid electroplating solution of the present invention. The concentration of the acetylenic compound(s) is generally between about 10 to 100 mgms. per liter of aqueous plating solution, and preferably the concentration is about 30 mgms. per liter.

Compounds of Formula (I) are preferably used in an electroplating solution in combination with one or more sulfonated pyridinium salts. Combination of the compounds of Formula (I) with one or more sulfonated pyridinium salts has been found to be synergistic with respect to leveling and brightening, although use of a sulfonated pyridinium salt does not appear to impart any appreciable degree of throwing power to the electroplating solution. A preferred compound is 1-(3-sulfopropyl)pyridinium betaine, available from Raschig Corporation. The concentration of 1-(3-sulfopropyl)-pyridinium betaine is generally about 20 to 500 mgms. per liter of electroplating solution, and preferably the concentration is about 180 mgms. per liter of solution.

The choice of nickel salt depends on the desired characteristics of the plated nickel. A hard, bright nickel deposit is achieved by use of only nickel halide salts. The nickel halide may be either nickel chloride or nickel bromide, although nickel chloride is typically employed. For such an electroplating solution, the nickel chloride concentration generally is about 300 grams nickel chloride hexahydrate per liter of aqueous plating solution.

For a nickel deposit with lower internal stress, a Watts-type solution is employed, such a solution comprising a mixture of nickel sulfate and nickel halide salts, with nickel chloride being the halide salt typically used. In general, the solution comprises between about 240 and 340 grams nickel sulfate hexahydrate per liter of aqueous plating solution and between about 30 and 60 grams nickel chloride hexahydrate per liter of solution and, preferably, the solution comprises about 240 grams nickel sulfate hexahydrate per liter of solution and about 60 grams nickel chloride hexahydrate per liter of solution.

Boric acid is the preferred acid employed in the plating solution in an amount between about 30 and 40 grams per liter of aqueous plating solution to provide a pH of between about 1.5 and 4.5.

The electroplating solution of the present invention preferably also includes formaldehyde added as a 37% aqueous solution. The electroplating solution bath may also include one or more surfactants to improve the solution's wettability, such as the anionic surfactant 1,3,6-naphthalene trisulfonic acid sodium salt.

The electroplating solution of the present invention is used to electroplate nickel on a substrate in the general manner and conditions of electroplating as disclosed in Coombs, *Printed Circuits Handbook*, pp. 7–22 to 7–25 (2d ed. 1979), incorporated herein by reference. More specifically, to plate printed circuit boards with nickel, the electroplating solution temperature is generally between about 45° C. and 70° C., preferably about 50° C. The electroplating solution is preferably agitated during use by any suitable means known in the art such as air sparger, work piece agitation or impingement. Plating is conducted at a current ranging between about 5 and 60 amps per square foot (ASF), preferably at a current of about 30 ASF. Prior to electrolytic deposition onto a through-hole wall, the wall surface is typically made conductive by electroless deposition.

When used in the described nickel electroplating solution, the compounds of Formula (I) provide exceptional throwing power. More particularly, a printed circuit board having through-holes and an aspect ratio equal to or greater than nine to one have been successfully nickel plated using the electroplating solution and compounds of the present invention.

Particularly preferred for plating printed circuit boards having high aspect ratio through-holes are the compounds of Formula (IA):

$$R-C\equiv C-R^1-[O-CH_2-CH(R^2)]_n-O-CH_2-CH(OH)-R^3 \quad (IA)$$

wherein

R is selected from the group consisting of hydrogen and $C_{1-8}$ alkyl;

$R^1$ is $C_{1-8}$ alkylene which may be substituted at available positions by one or more $C_{1-5}$ alkyl groups;

$R^2$ and $R^3$ each is $C_{1-5}$ hydroxyalkyl;

and n is an integer greater than zero and less than the value wherein the compound is not soluble in an aqueous acid nickel electroplating solution at concentrations of less than 10 parts of the compound per million parts of the electroplating solution.

Thus, particularly good throwing power has been imparted to a nickel electroplating solution through use of the compounds of Formula (IA) wherein R is hydrogen; $R^1$ is $CH_2$; $R^2$ is $CH_2OH$; $R^3$ is $CH_2OH$; and n is 1 or 2.

Though not wishing to be bound by theory, it is believed the compounds of Formula (I) provide good throwing power to a nickel electroplating solution by the combination of: (i) nickel ions complexing with the compounds' one or more acetylenic groups; and (ii) enhanced laminar flow of the electroplating solution provided by the compounds' multiple ether groups.

It is further believed the compound(s) of Formula (I) will provide good throwing to a nickel electroplating bath unless the particular compound is insoluble in an aqueous acid nickel electroplating solution at effective concentrations, i.e., less than 10 mgms. of the compound per liter of the electroplating solution. Thus, good throwing power should be provided by compounds of Formula (I) having molecular weights up to and in excess of 50,000 where the groups $R^2$ and $R^3$ are substituted with water soluble moieties such as sulfono and hydroxy.

The invention will be better understood by reference to the following examples. As shown by Examples 6 through 9, the present invention enables nickel plating of printed circuit boards having through-holes of high aspect ratios.

EXAMPLE 1

A preferred nickel chloride electroplating solution in accordance with the invention is as follows:

| Ingredient | Concentration |
|---|---|
| Nickel chloride hexahydrate | 300 gm/l |
| Compound(s) of Formula (I) | 30 mgm/l |
| 1-(3-sulfopropyl) pyridinium betaine | 180 mgm/l |
| Formaldehyde (37% aqueous solution) | 150 mgm/l |
| Boric acid | 38 gm/l |
| Water | up to 1 liter |

EXAMPLE 2

A preferred Watts-type electroplating solution in accordance with the invention is as follows:

| Ingredient | Concentration |
|---|---|
| Nickel sulfate hexahydrate | 240 gm/l |
| Nickel chloride hexahydrate | 60 gm/l |
| Compound(s) of Formula (I) | 30 mgm/l |
| 1-(3-sulfopropyl) pyridinium betaine | 180 mgm/l |
| Formaldehyde (37% aqueous solution) | 150 mgm/l |
| Boric acid | 40 gm/l |
| Water | up to 1 liter |

EXAMPLE 3

1-propargyl glyceryl ether was obtained from Raschig Corporation. This commercial product was 80–85% pure and was purified by vacuum distillation. At about 0.1 mm/Hg a fraction boiling at about 90°–95° C. was collected; at about 140°–145° C. a second fraction was collected; and at about 200° C. a third fraction was collected.

Analytical data (infrared spectrometry, gel permeation chromatography, elemental analysis, NMR) showed the fraction boiling at 90°–95° C. at 0.1 mm/Hg to be essentially pure 1-propargyl glyceryl ether; the fraction boiling at 140°–145° C. at 0.1 mm/Hg to be the compound of Formula (I) where R is hydrogen, $R^1$ is $CH_2$, $R^2$ is $CH_2OH$, $R^3$ is $CH_2OH$, and n is 1; and the fraction boiling at about 200° C. at 0.1 mm/Hg to include the compound of Formula (I) where R is hydrogen, $R^1$ is $CH_2$, $R^2$ is $CH_2OH$, $R^3$ is $CH_2OH$, and n is 2.

EXAMPLE 4

The procedure described by C. P. Yang, et al., *Tatung Journal,* Vol. XIII, pg. 203–213 (Nov. 1983), is followed. Epichlorohydrin (2 moles) is condensed with propargyl alcohol (1 mole) to yield 2-propanol, 1-chloro-3-[1-(chloromethyl)-2-(2-propynyloxy)ethoxy]. This dichloro compound is then hydrolyzed by refluxing the compound in an aqueous solution in the presence of sodium carbonate until disappearance of the oily layer of the dichloro compound is obversed. Evaporation of water in vacuo is followed by filtration of the reaction solution and then distillation under reduced pressure yields the compound $HC\equiv CCH_2OCH_2CH(CH_2OH)OCH_2CH(OH)CH_2OH$ (propargyl diglyceryl ether).

EXAMPLE 5

It is anticipated other acetylenic compounds of Formula (I) can be readily prepared using appropriate reagents and the general procedures of Example 4, that is, the following sequential steps: (a) condensation of one mole of an acetylenic alcohol with one or moles of an epoxide in the presence of a catalytic amount of $BF_3$; (b) optional hydrolysis, sulfonation, or cyanogenation of the chlorohydrin formed in step (a); and (c) distillation or other purification of the reaction product of step (b). Condensation of an acetylenic alcohol with greater than one mole of an epoxide(s) in step (a) should provide higher molecular weight compounds of Formula (I), i.e., compounds where "n" of Formula (I) is greater than 1. It is thus anticipated that compounds of Formula (I) where, for example, the value of "n" is 30 or greater can be prepared by multiple epoxide condensation reactions.

Variations from this synthetic scheme are apparent to those skilled in the art. Using epichlorohydrin as the epoxide in step (a) above and hydrolyzing the chlorohydrin to hydroxyalkyl in step (b), several acetylenic alcohols that may be employed to yield several compounds of Formula (I) are as follows:

| Acetylenic alcohol of step (a) | Compound of Formula (I) realized after step (c) |
|---|---|
| (1) 2-pentyn-1-ol | R is $C_2H_5$<br>$R^1$ is $CH_2$<br>$R^2$ and $R^3$ each is $CH_2OH$<br>n is 1 |
| (2) 3-butyn-2-ol | R is hydrogen<br>$R^1$ is $CH(CH_3)$<br>$R^2$ and $R^3$ each is $CH_2OH$<br>n is 1 |
| (3) 3-methyl-2-penten-4-yn-1-ol | R is hydrogen<br>$R^1$ is $C(CH_3)=CHCH_2$<br>$R^2$ and $R^3$ each is $CH_2OH$<br>n is 1 |

The nickel chloride electroplating solution of Example 1 was prepared except the acetylenic compound was propargyl glyceryl ether obtained from Raschig Corporation and purified by fractional distillation at 0.1 mm/Hg. A copper pattern plated multilayer printed circuit board having through-holes and aspect ratio of 12:1 was immersed in this electroplating solution heated to 50° C. The circuit board was subjected to electrolysis therein at 10 ASF until a 0.5 mil nickel deposit was formed on the board's plane surface.

The board surface displayed a bright, level nickel deposit. Cross-sectioning of the board showed, however, that the mid-barrels of the through-holes were not plated with nickel.

EXAMPLE 7

The nickel chloride electroplating solution of Example 1 was prepared except the acetylenic compounds were: (i) approximately 26 mgms. of 1-propargyl glyceryl ether; (ii) approximately 3 mgms. of the compound of Formula (I) where R is $CH_3$; $R^1$ is $CH_2$; $R^2$ is $CH_2OH$; $R^3$ is $CH_2OH$; and n is 1; and (iii) approximately 1 mgm. of the compound of Formula (I) where R is $CH_3$; $R^1$ is $CH_2$; $R^2$ is $CH_2OH$; $R^3$ is $CH_2OH$; and n is 2. A copper pattern plated multilayer circuit board having through-holes and aspect ratio of 12:1 was immersed in this electroplating bath heated to about 50° C. The circuit board was subjected to electrolysis therein at about 10 ASF until a 0.5 mil. nickel deposit was formed on the board's plane surface. The board displayed a bright, level nickel deposit. Cross-sectioning of the board showed nickel plated along the through-holes' entire length with a 0.2 mil deposit at the midpoint of the holes' barrels.

EXAMPLE 8

The nickel chloride electroplating bath of Example 1 was prepared where the compound of Formula (I) was $HC{\equiv}CCH_2OCH_2CH(CH_2OH)OCH_2CH(OH)CH_2OH$. A copper pattern plated multilayer printed circuit board having through-holes and aspect ratio of 28:1 was immersed in the electroplating bath heated to 50° C. The circuit board was subjected to electrolysis therein at 5 ASF until a 2.2 mil nickel deposit was formed on the board's plane surface. The board surface displayed a bright, level nickel deposit. Cross-sectioning of the board showed nickel plated along the through-holes' entire length with a 0.044 mil deposit at the midpoint of the holes' barrel.

EXAMPLE 9

The nickel electroplating sequence of Example 8 was repeated, except the compound of Formula (I) present in the bath was $HC{\equiv}CCH_2[OCH_2CH(CH_2OH)]_2OCH_2CH(OH)CH_2OH$. The board was subjected to electrolysis until a 1.1 mil. nickel deposit was formed on the board's plane surface. The board surface displayed a bright, level nickel deposit. Cross-sectioning of the board showed nickel plated along the through-holes' entire length with a 0.11 mil deposit at the midpoint of the holes' barrel.

The foregoing description of the present invention is merely illustrative thereof, and it is understood that variations and modifications can be affected without departing from the spirit or scope of the invention as set forth in the following claims.

I claim:

1. An aqueous acid solution for the electrodeposition of nickel on an irregular surface, the solution comprising:

(a) nickel ions; and (b) one or more compounds of Formula (I):

$$R{-}C{\equiv}C{-}R^1{-}[O{-}CH_2{-}CH(R^2)]_n{-}O{-}CH_2(OH){-}R^3 \quad (I)$$

wherein

R is selected from the group consisting of hydrogen, $C_{1-8}$ alkyl, $C_{1-8}$ alkoxy, $C_{2-8}$ alkenyl and $C_{2-8}$ alkynyl any of which groups may be substituted at available positions by one or more hydroxy, halo and sulfono;

$R^1$ is selected from the group consisting of $C_{1-8}$ alkylene, $C_{2-8}$ alkenylene and $C_{2-8}$ alkynylene, any of which groups may be substituted at available positions by $C_{1-5}$ alkyl and $C_{2-5}$ alkenyl;

$R^2$ is selected from the group consisting of hydrogen $C_{1-5}$ alkyl, $C_{2-5}$ alkenyl and $C_{2-5}$ alkynyl, any of which groups may be substituted at available positions by one or more hydroxy;

$R^3$ is selected from the groups consisting of $C_{1-5}$ alkyl, $C_{2-5}$ alkenyl and $C_{2-5}$ alkynyl, any of which groups may be substituted at available positions by one or more hydroxy; and n is any integer greater than zero and less than the value wherein the compound is not soluble in an aqueous acid nickel electroplating solution at concentrations of less than 10 parts of the compound per million parts of the electroplating solution.

2. The solution of claim 1 where the solution contains between about 10 and 100 mgms. per liter of one or more compounds of Formula (I).

3. The solution of claim 1 where the solution contains a sulfonated pyridinium salt.

4. The solution of claim 3 where the sulfonated pyridinium salt is N-(3-sulfopropyl)pyridinium betaine.

5. The solution of claim 4 where the solution contains between about 20 and 500 mgms. per liter of N-(3-sulfopropyl)pyridinium betaine.

6. The solution of claim 1 where the acid is boric acid.

7. The solution of claim 1 where the solution contains one or more surfactants.

8. The solution of claim 7 where the one or more surfactants is 1,3,6-naphthalene trisulfonic acid sodium salt.

9. The solution of claim 1 where the one or more compounds of Formula (I) is the compound where R is hydrogen; $R^1$ is $CH_2$; $R^2$ and $R^3$ are each $CH_2OH$; and n is 1.

10. The solution of claim 1 wherein the one or more compounds of Formula (I) is the compound where R is hydrogen; $R^1$ is $CH_2$; $R^2$ and $R^3$ are each $CH_2OH$; and n is 2.

11. A process for electrolytically depositing nickel on an irregular surface, the process comprising the step of:

electrolytically depositing nickel onto the surface from an aqueous acid nickel plating solution, the solution comprising nickel ions and one or more of the compounds of the following Formula (I):

$$R{-}C{\equiv}C{-}R^1{-}[O{-}CH_2{-}CH(R^2)]_n{-}O{-}CH_2(OH){-}R^3 \quad (I)$$

wherein

R is selected from the group consisting of hydrogen, $C_{1-8}$ alkyl, $C_{1-8}$ alkoxy, $C_{2-8}$ alkenyl and $C_{2-8}$ alkynyl any of which groups may be substituted at available positions by one or more hydroxy, halo, sulfono and cyanao;

$R^1$ is selected from the group consisting of $C_{1-8}$ alkylene, $C_{2-8}$ alkenylene and $C_{2-8}$ alkynylene, any of which groups may be substituted at available positions by $C_{1-5}$ alkyl and $C_{2-5}$ alkenyl;

$R^2$ is selected from the group consisting of hydrogen $C_{1-5}$ alkyl, $C_{2-5}$ alkenyl and $C_{2-5}$ alkynyl, any of which groups may be substituted at available positions by one or more hydroxy;

$R^3$ is selected from the groups consisting of $C_{1-5}$ alkyl, $C_{2-5}$ alkenyl and $C_{2-5}$ alkynyl, any of which groups may be substituted at available positions by one or more hydroxy, halo, cyano and sulfono; and n is any integer greater than zero and less than the value wherein the compound is not soluble in an aqueous acid nickel electroplating solution at concentrations of less than 10 parts of the compound per million parts of the electroplating solution.

12. A process for electrolytically depositing nickel on an irregular surface, the process comprising the step of:

electrolytically depositing nickel on the surface from an aqueous acid nickel plating solution, the solution comprising nickel ions and one or more compounds of the following Formula (IA):

$$R{-}C{\equiv}C{-}R^1{-}[O{-}CH_2{-}CH(R^2)]_n{-}O{-}CH_2(OH){-}R^3 \quad (IA)$$

wherein

R is selected from the group consisting of hydrogen and $C_{14\ 8}$ alkyl;

$R^1$ is $C_{1-8}$ alkylene which may be substituted at available positions by $C_{1-5}$ alkyl;

$R^2$ and $R^3$ each is $C_{1-5}$ hydroxyalkyl; and n is any integer greater than zero and less than the value wherein the compound is not soluble in an aqueous acid nickel electroplating solution at concentrations of less than 10 parts of the compound per million parts of the electroplating solution.

13. The process of claim 12 where the one or more compounds of Formula (IA) is the compound where R is hydrogen; $R^1$ is $CH_2$; $R^2$ and $R^3$ are each $CH_2OH$; and n is 1.

14. The process of claim 12 where the one or more compounds of Formula (IA) is the compound where R is hydrogen; $R^1$ is $CH_2$; $R^2$ and $R^3$ are each $CH_2OH$; and n is 2.

15. The process of claims 11 or 12 where the surface has one or more openings therein.

16. The process of claims 11, 12 or 13 where the surface in a printed circuit board having through-holes.

17. The process of claims 11, 12 or 13 where the surface is a printed circuit board having through holes, the through holes having an aspect ratio equal to or greater than nine to one.

18. The process of claim 11 where the value n of Formula (I) is between 2 and 30.

19. The process of claim 12 where the value n of Formula (IA) is between 2 and 30.

20. The process of claim 17 where the value n of Formula I or IA is between 2 and about 30.

* * * * *